US007674364B2

(12) United States Patent
Loh et al.

(10) Patent No.: US 7,674,364 B2
(45) Date of Patent: Mar. 9, 2010

(54) HYDRAULIC FLUID COMPOSITIONS AND PREPARATION THEREOF

(75) Inventors: William Loh, Petaluma, CA (US); John M. Rosenbaum, Richmond, CA (US); Nancy J. Bertrand, Lafayette, CA (US); Patricia V. Lemay, Vallejo, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 384 days.

(21) Appl. No.: 11/845,935

(22) Filed: Aug. 28, 2007

(65) Prior Publication Data

US 2008/0029430 A1 Feb. 7, 2008

Related U.S. Application Data

(63) Continuation-in-part of application No. 11/078,746, filed on Mar. 11, 2005, now Pat. No. 7,435,327, and a continuation-in-part of application No. 11/316,311, filed on Dec. 21, 2005, and a continuation-in-part of application No. 11/316,310, filed on Dec. 21, 2005, now Pat. No. 7,547,666.

(51) Int. Cl.
*C10M 145/14* (2006.01)
*C10G 71/00* (2006.01)

(52) U.S. Cl. ..... 208/18; 208/19; 508/469

(58) Field of Classification Search ..... 208/18, 208/19; 508/469

See application file for complete search history.

(56) References Cited

U.S. PATENT DOCUMENTS

| | | | |
|---|---|---|---|
| 4,029,588 | A | 6/1977 | Koch |
| 4,116,877 | A | 9/1978 | Outten et al. |
| 6,059,955 | A | 5/2000 | Cody et al. |
| 6,096,940 | A | 8/2000 | Wittenbrink et al. |
| 6,150,577 | A | 11/2000 | Miller et al. |
| 6,392,108 | B1 | 5/2002 | O'Rear et al. |
| 6,506,297 | B1 | 1/2003 | Wittenbrink et al. |
| 6,518,321 | B1 | 2/2003 | O'Rear et al. |
| 6,579,441 | B1 | 6/2003 | Biscardi et al. |
| 6,589,415 | B2 | 7/2003 | Smith et al. |
| 6,627,779 | B2 | 9/2003 | O'Rear et al. |
| 6,656,342 | B2 | 12/2003 | Smith et al. |
| 6,699,385 | B2 | 3/2004 | Miller et al. |
| 6,703,353 | B1 | 3/2004 | Lok et al. |
| 6,713,657 | B2 | 3/2004 | O'Rear et al. |
| 6,773,578 | B1 | 8/2004 | O'Rear et al. |
| 6,774,272 | B2 | 8/2004 | Miller et al. |
| 6,806,237 | B2 | 10/2004 | O'Rear et al. |
| 6,822,126 | B2 | 11/2004 | Miller et al. |
| 6,833,065 | B2 | 12/2004 | O'Rear et al. |
| 6,833,484 | B2 | 12/2004 | O'Rear et al. |
| 6,878,854 | B2 | 4/2005 | O'Rear et al. |
| 6,890,423 | B2 | 5/2005 | O'Rear et al. |
| 6,900,366 | B2 | 5/2005 | Rosenbaum et al. |
| 6,924,404 | B2 | 8/2005 | O'Reilly et al. |
| 6,962,651 | B2 | 11/2005 | Miller et al. |
| 7,018,525 | B2 | 3/2006 | Miller et al. |
| 7,045,055 | B2 | 5/2006 | Ziemer et al. |
| 7,053,254 | B2 | 5/2006 | Miller et al. |
| 7,067,049 | B1 | 6/2006 | Baillargeon et al. |
| 7,083,713 | B2 | 8/2006 | Abernathy et al. |
| 7,141,157 | B2 | 11/2006 | Rosenbaum et al. |
| 7,144,497 | B2 | 12/2006 | Lok et al. |
| 2004/0159582 | A1 | 8/2004 | Simmons et al. |
| 2004/0181110 | A1 | 9/2004 | Miller et al. |
| 2004/0232045 | A1 | 11/2004 | Simmons et al. |
| 2004/0256286 | A1 | 12/2004 | Miller et al. |
| 2004/0256287 | A1 | 12/2004 | Miller et al. |
| 2005/0077208 | A1 | 4/2005 | Miller et al. |
| 2005/0133407 | A1 | 6/2005 | Abernathy et al. |
| 2005/0133409 | A1 | 6/2005 | Abernathy et al. |

(Continued)

FOREIGN PATENT DOCUMENTS

| | | |
|---|---|---|
| EP | 1626080 | 2/2006 |
| WO | WO2005000999 | 1/2005 |

OTHER PUBLICATIONS

Industrial Solvents Handbook, copyright 2003, v. 94, pp. 75-76.
Polymer Characterization: Laboratory Techniques and Analysis, copyright 1996, p. 187.
Turbine Lubrication in the 21st Century, copyright 2001, pp. 53-70.
Chemistry and Technology of Lubricants, copyright 1992 & second edition 1997, pp. 54-58.
CRC Handbook of Solubility Parameters and Other Cohesion Parameters, copyright 1991, pp. 95-111.
Using Hansen Parameters to understand Chemical Compatibility, Clarke et al, www.mycrolis.com.

*Primary Examiner*—Walter D Griffin
*Assistant Examiner*—Frank C Campanell
(74) *Attorney, Agent, or Firm*—Penny L. Prater

(57) ABSTRACT

A hydraulic fluid composition having excellent seal compatibility is prepared from an isomerized base oil is provided. The composition comprising (i) 80 to 99.999 wt. % of a lubricating base oil having consecutive numbers of carbon atoms, less than 10 wt % naphthenic carbon by n-d-M, less than 0.10 wt. % olefins and less than 0.05 wt. % aromatics, a molecular weight of greater than 600 by ASTM D 2503-92 (Reapproved 2002), a wt % total molecules with cycloparaffinic functionality greater than 25 and a ratio of molecules with monocycloparaffinic functionality to molecules with multicycloparaffinic functionality greater than 10; and (ii) optionally from 0.001 to 6 wt % of a viscosity modifier; and (iii) 0-10 wt % of at least an additive package. When used in operations, the composition results in an average volume change in a rubber seal of less than 3% and an average hardness change in the rubber seal of less than 1 pts. when tested under ASTM D 471-06 (SRE NBR1 at 100° C., 168 hours).

24 Claims, No Drawings

U.S. PATENT DOCUMENTS

2005/0139513 A1 6/2005 Miller et al.
2005/0139514 A1 6/2005 Miller et al.
2005/0247600 A1 11/2005 Miller et al.
2005/0258078 A1 11/2005 Rosenbaum et al.
2005/0261145 A1 11/2005 Rosenbaum et al.
2005/0261146 A1 11/2005 Rosenbaum et al.
2005/0261147 A1 11/2005 Rosenbaum et al.
2006/0016721 A1 1/2006 Miller et al.
2006/0016724 A1 1/2006 Miller et al.
2006/0027486 A1 2/2006 Rosenbaum et al.
2006/0065573 A1 3/2006 Dieckmann et al.
2006/0069295 A1 3/2006 Dieckmann et al.
2006/0069296 A1 3/2006 Dieckmann et al.
2006/0070914 A1 4/2006 Miller et al.
2006/0076266 A1 4/2006 Miller et al.
2006/0076267 A1 4/2006 Miller et al.
2006/0091043 A1 5/2006 Miller et al.
2006/0113216 A1 6/2006 Rosenbaum et al.
2006/0113512 A1 6/2006 Rosenbaum et al.
2006/0131210 A1 6/2006 Rosenbaum et al.
2006/0196807 A1 9/2006 Rosenbaum et al.
2006/0199743 A1 9/2006 Rosenbaum et al.
2006/0199748 A1 9/2006 Costello et al.
2006/0201851 A1 9/2006 Rosenbaum et al.
2006/0201852 A1 9/2006 Rosenbaum et al.
2006/0205610 A1 9/2006 Rosenbaum et al.
2006/0237344 A1 10/2006 Abernathy et al.
2007/0142250 A1 6/2007 Loh et al.
2007/0238628 A1 10/2007 Haire et al.
2007/0293408 A1 12/2007 Opstal et al.

HYDRAULIC FLUID COMPOSITIONS AND PREPARATION THEREOF

CROSS REFERENCE TO RELATED APPLICATIONS

This application is a continuation-in-part of U.S. patent application Ser. No. 11/078,746, now U.S. Pat. No. 7,435,327 B2, filed Mar. 11, 2005; U.S. patent application Ser. No. 11/316,311 filed Dec. 21, 2005; and U.S. patent application Ser. No. 11/316,310, now U.S. Pat. No. 7,547,666 B2, filed Dec. 21, 2005. This application claims priority to and benefits from the foregoing, the disclosures of which are incorporated herein by reference.

TECHNICAL FIELD

The invention relates generally to hydraulic fluid compositions, and more specifically to hydraulic fluid compositions having excellent seal compatibility.

BACKGROUND

Hydraulic fluids serve as the power transmission medium in a hydraulic system and are designed to transmit force and motion in industrial hydraulic systems. A very high percentage of industrial non-mobile hydraulic systems and mobile vehicles such as automobiles, tractors and earthmovers are now equipped with some type of semi-automatic or fully automatic transmission. These hydraulic systems and transmissions must be provided with a supply of a "functional" fluid that serves at least a function of a power transmitting medium, a hydraulic control fluid, a heat transfer medium, and a satisfactory lubricant. The problem of shrinkage of seals, particularly elastomeric seals, upon contact with functional fluids is important since such shrinkage causes leakage of the functional fluid which can lead to defective operation of the hydraulic equipment and vehicles.

To eliminate this problem, it is conventional to include in the functional fluid an additive whose presence therein causes the seal to swell. A number of such additives are known in the art. U.S. Pat. No. 4,029,588 discloses a substituted sulfolane in which one of the substituents is a 3-alkoxy or 3-alkylthio group, or the like, for swelling seals in machinery in an amount of 0.05-20.0 wt. %, and preferably in an amount of 0.1-5.0 wt. %. U.S. Pat. No. 4,116,877 discloses a functional fluid comprising a mineral lubricating oil base and 5-20 wt. % of seal swell agents comprising an oil-soluble tris($C_8$-$C_{24}$ hydrocarbyl) phosphite ester and an oil-soluble $C_8$-$C_{24}$ hydrocarbyl substituted phenol, whereby the elastomer compatibility of the fluid is enhanced. Seal swell additives are quite often used in undesirably large quantities in the functional fluid and often have several disadvantages. Some are toxic. Some would lower or raise the viscosity of fluid and or/impair its oxidation stability. Some when added in a large amount will cause the seal to swell against the shaft or hydraulic cylinder rod, leading to increased seal wear.

In a number of patent publications and applications, i.e., US 2006/0289337, US2006/0201851, US2006/0016721, US2006/0016724, US2006/0076267, US2006/020185, US2006/013210, US2005/0241990, US2005/0077208, US2005/0139513, US2005/0139514, US2005/0133409, US2005/0133407, US2005/0261147, US2005/0261146, US2005/0261145, US2004/0159582, U.S. Pat. No. 7,018,525, U.S. Pat. No. 7,083,713, U.S. application Ser. Nos. 11/400,570, 11/535,165 and 11/613,936, which are incorporated herein by reference, a Fischer Tropsch base oil is produced from a process in which the feed is a waxy feed recovered from a Fischer-Tropsch synthesis. The process comprises a complete or partial hydroisomerization dewaxing step, using a dual-functional catalyst or a catalyst that can isomerize paraffins selectively. Hydroisomerization dewaxing is achieved by contacting the waxy feed with a hydroisomerization catalyst in an isomerization zone under hydroisomerizing conditions. The Fischer-Tropsch synthesis products can also be obtained by well-known processes such as, for example, the commercial SASOL® Slurry Phase Fischer-Tropsch technology, the commercial SHELL® Middle Distillate Synthesis (SMDS) Process, or by the non-commercial EXXON® Advanced Gas Conversion (AGC-21) process.

There is a still a need for functional fluids, particularly functional fluids employing Fischer Tropsch base oils, that are capable of operating over a wide temperature range, possess a high degree of oxidation resistance, be free of corrosive action, have foam control, have satisfactory low temperature fluidity, retain a useful viscosity at high temperatures, requiring minimal or no seal swell additive while still retaining excellent transmission seal compatibility.

SUMMARY OF THE INVENTION

In one embodiment, there is provided a hydraulic fluid composition comprising (i) 80 to 99.999 wt. % of a lubricating base oil having consecutive numbers of carbon atoms, less than 10 wt % naphthenic carbon by n-d-M, less than 0.10 wt. % olefins and less than 0.05 wt. % aromatics; (ii) optionally from 0.001 to 6 wt % of a viscosity modifier; and (iii) 0-10 wt % of at least an additive package; wherein the hydraulic fluid composition results in an average volume change in a rubber seal of less than 3% and an average hardness change in the rubber seal of less than 1 pts. when tested under ASTM D 471-06 (SRE NBR1 at 100° C., 168 hours).

In another aspect, there is provided a method to minimize deterioration and leakage in hydraulic transmission seals, for rubber seals used in the hydraulic transmission to have less than 3% average volume change and less than 1 pts. in average hardness when tested under ASTM D 471-06 (SRE NBR1 at 100° C., 168 hours), the method comprising using a hydraulic fluid composition comprising (i) 80 to 99.999 wt. % of a lubricating base oil having consecutive numbers of carbon atoms, less than 10 wt % naphthenic carbon by n-d-M, less than 0.10 wt. % olefins and less than 0.05 wt. % aromatics; (ii) optionally 0.001 to 6 wt % of a viscosity modifier; and (iii) 0-10 wt % of at least an additive package.

DETAILED DESCRIPTION

The following terms will be used throughout the specification and will have the following meanings unless otherwise indicated.

As used herein, "hydraulic fluid" is used interchangeably with "functional fluid," denoting a fluid for use in the transmission of energy in vehicles and equipment, such as a lubricant, hydraulic fluid, automatic transmission fluid, heat exchange medium or the like.

"Fischer-Tropsch derived" means that the product, fraction, or feed originates from or is produced at some stage by a Fischer-Tropsch process. As used herein, "Fischer-Tropsch base oil" may be used interchangeably with "FT base oil," "FTBO," "GTL base oil" (GTL: gas-to-liquid), or "Fischer-Tropsch derived base oil."

As used herein, "isomerized base oil" refers to a base oil made by isomerization of a waxy feed.

As used herein, a "waxy feed" comprises at least 40 wt % n-paraffins. In one embodiment, the waxy feed comprises greater than 50 wt % n-paraffins. In another embodiment, greater than 75 wt % n-paraffins. In one embodiment, the waxy feed also has very low levels of nitrogen and sulphur, e.g., less than 25 ppm total combined nitrogen and sulfur, or in other embodiments less than 20 ppm. Examples of waxy feeds include slack waxes, deoiled slack waxes, refined foots oils, waxy lubricant raffinates, n-paraffin waxes, NAO waxes, waxes produced in chemical plant processes, deoiled petroleum derived waxes, microcrystalline waxes, Fischer-Tropsch waxes, and mixtures thereof. In one embodiment, the waxy feeds have a pour point of greater than 50° C. In another embodiment, greater than 60° C.

As used herein, "pour point reducing blend component" refers to an isomerized waxy product with relatively high molecular weights and a specified degree of alkyl branching in the molecule, such that it reduces the pour point of lubricating base oil blends containing it. Examples of a pour point reducing blend component are disclosed in U.S. Pat. Nos. 6,150,577 and 7,053,254, and Patent Publication No. US 2005-0247600 A1. A pour point reducing blend component can be: 1) an isomerized Fischer-Tropsch derived bottoms product; 2) a bottoms product prepared from an isomerized highly waxy mineral oil, or 3) an isomerized oil having a kinematic viscosity at 100° C. of at least about 8 $mm^2/s$ made from polyethylene plastic.

As used herein, the "10 percent point" of the boiling range of a pour point reducing blend component refers to the temperature at which 10 weight percent of the hydrocarbons present within that cut will vaporize at atmospheric pressure. Similarly, the 90 percent point of the respective boiling ranges refers to the temperature at which 90 weight percent of the hydrocarbons present within that cut will vaporize at atmospheric pressure. For samples having a boiling range above 1000° F. (538° C.), the boiling range can be measured using the standard analytical method D-6352-04 or its equivalent. For samples having a boiling range below 1000° F. (538° C.), the boiling range distributions in this disclosure can be measured using the standard analytical method D-2887-06 or its equivalent. It will be noted that only the 10 percent point of the respective boiling range is used when referring to the pour point reducing blend component that is a vacuum distillation bottoms product, since it is derived from a bottoms fraction which makes the 90 percent point or upper boiling limit irrelevant.

"Kinematic viscosity" is a measurement in $mm^2/s$ of the resistance to flow of a fluid under gravity, determined by ASTM D445-06.

"Viscosity index" (VI) is an empirical, unit-less number indicating the effect of temperature change on the kinematic viscosity of the oil. The higher the VI of an oil, the lower its tendency to change viscosity with temperature. Viscosity index is measured according to ASTM D 2270-04.

Cold-cranking simulator apparent viscosity (CCS VIS) is a measurement in millipascal seconds, mPa·s to measure the viscometric properties of lubricating base oils under low temperature and high shear. CCS VIS is determined by ASTM D 5293-04.

The boiling range distribution of base oil, by wt %, is determined by simulated distillation (SIMDIS) according to ASTM D 6352-04, "Boiling Range Distribution of Petroleum Distillates in Boiling Range from 174 to 700° C. by Gas Chromatography."

"Noack volatility" is defined as the mass of oil, expressed in weight %, which is lost when the oil is heated at 250° C. with a constant flow of air drawn through it for 60 min., measured according to ASTM D5800-05, Procedure B.

Brookfield viscosity is used to determine the internal fluid-friction of a lubricant during cold temperature operation, which can be measured by ASTM D 2983-04.

"Pour point" is a measurement of the temperature at which a sample of base oil will begin to flow under certain carefully controlled conditions, which can be determined as described in ASTM D 5950-02.

"Auto ignition temperature" is the temperature at which a fluid will ignite spontaneously in contact with air, which can be determined according to ASTM 659-78.

"Ln" refers to natural logarithm with base "e."

"Traction coefficient" is an indicator of intrinsic lubricant properties, expressed as the dimensionless ratio of the friction force F and the normal force N, where friction is the mechanical force which resists movement or hinders movement between sliding or rolling surfaces. Traction coefficient can be measured with an MTM Traction Measurement System from PCS Instruments, Ltd., configured with a polished 19 mm diameter ball (SAE AISI 52100 steel) angled at 220 to a flat 46 mm diameter polished disk (SAE AISI 52100 steel). The steel ball and disk are independently measured at an average rolling speed of 3 meters per second, a slide to roll ratio of 40 percent, and a load of 20 Newtons. The roll ratio is defined as the difference in sliding speed between the ball and disk divided by the mean speed of the ball and disk, i.e. roll ratio=(Speed1−Speed2)/((Speed1+Speed2)−/2).

As used herein, "consecutive numbers of carbon atoms" means that the base oil has a distribution of hydrocarbon molecules over a range of carbon numbers, with every number of carbon numbers in-between. For example, the base oil may have hydrocarbon molecules ranging from C22 to C36 or from C30 to C60 with every carbon number in-between. The hydrocarbon molecules of the base oil differ from each other by consecutive numbers of carbon atoms, as a consequence of the waxy feed also having consecutive numbers of carbon atoms. For example, in the Fischer-Tropsch hydrocarbon synthesis reaction, the source of carbon atoms is CO and the hydrocarbon molecules are built up one carbon atom at a time. Petroleum-derived waxy feeds have consecutive numbers of carbon atoms. In contrast to an oil based on poly-alpha-olefin ("PAO"), the molecules of an isomerized base oil have a more linear structure, comprising a relatively long backbone with short branches. The classic textbook description of a PAO is a star-shaped molecule, and in particular tridecane, which is illustrated as three decane molecules attached at a central point. While a star-shaped molecules is theoretical, nevertheless PAO molecules have fewer and longer branches that the hydrocarbon molecules that make up the isomerized base oil disclosed herein.

"Molecules with cycloparaffinic functionality" mean any molecule that is, or contains as one or more substituents, a monocyclic or a fused multicyclic saturated hydrocarbon group.

"Molecules with monocycloparaffinic functionality" mean any molecule that is a monocyclic saturated hydrocarbon group of three to seven ring carbons or any molecule that is substituted with a single monocyclic saturated hydrocarbon group of three to seven ring carbons.

"Molecules with multicycloparaffinic functionality" mean any molecule that is a fused multicyclic saturated hydrocarbon ring group of two or more fused rings, any molecule that is substituted with one or more fused multicyclic saturated hydrocarbon ring groups of two or more fused rings, or any molecule that is substituted with more than one monocyclic saturated hydrocarbon group of three to seven ring carbons.

Molecules with cycloparaffinic functionality, molecules with monocycloparaffinic functionality, and molecules with multicycloparaffinic functionality are reported as weight percent and are determined by a combination of Field Ionization Mass Spectroscopy (FIMS), HPLC-UV for aromatics, and Proton NMR for olefins, further fully described herein.

Oxidator BN measures the response of a lubricating oil in a simulated application. High values, or long times to adsorb one liter of oxygen, indicate good stability. Oxidator BN can be measured via a Dornte-type oxygen absorption apparatus (R. W. Dornte "Oxidation of White Oils," Industrial and Engineering Chemistry, Vol. 28, page 26, 1936), under 1 atmosphere of pure oxygen at 340° F., time to absorb 1000 ml of $O_2$ by 100 g. of oil is reported. In the Oxidator BN test, 0.8 ml of catalyst is used per 100 grams of oil. The catalyst is a mixture of soluble metal-naphthenates simulating the average metal analysis of used crankcase oil. The additive package is 80 millimoles of zinc bispolypropylenephenyldithiophosphate per 100 grams of oil.

Molecular characterizations can be performed by methods known in the art, including Field Ionization Mass Spectroscopy (FIMS) and n-d-M analysis (ASTM D 3238-95 (Reapproved 2005)). In FIMS, the base oil is characterized as alkanes and molecules with different numbers of unsaturations. The molecules with different numbers of unsaturations may be comprised of cycloparaffins, olefins, and aromatics. If aromatics are present in significant amount, they would be identified as 4-unsaturations. When olefins are present in significant amounts, they would be identified as 1-unsaturations. The total of the 1-unsaturations, 2-unsaturations, 3-unsaturations, 4-unsaturations, 5-unsaturations, and 6-unsaturations from the FIMS analysis, minus the wt % olefins by proton NMR, and minus the wt % aromatics by HPLC-UV is the total weight percent of molecules with cycloparaffinic functionality. If the aromatics content was not measured, it was assumed to be less than 0.1 wt % and not included in the calculation for total weight percent of molecules with cycloparaffinic functionality. The total weight percent of molecules with cycloparaffinic functionality is the sum of the weight percent of molecules with monocycloparaffinic functionality and the weight percent of molecules with multicycloparaffinic functionality.

Molecular weights are determined by ASTM D2503-92 (Reapproved 2002). The method uses thermoelectric measurement of vapour pressure (VPO). In circumstances where there is insufficient sample volume, an alternative method of ASTM D2502-94 may be used; and where this has been used it is indicated.

Density is determined by ASTM D4052-96 (Reapproved 2002). The sample is introduced into an oscillating sample tube and the change in oscillating frequency caused by the cange in the mass of the tube is used in conjunction with calibration data to determine the density of the sample.

Weight percent olefins can be determined by proton-NMR according to the steps specified herein. In most tests, the olefins are conventional olefins, i.e. a distributed mixture of those olefin types having hydrogens attached to the double bond carbons such as: alpha, vinylidene, cis, trans, and trisubstituted, with a detectable allylic to olefin integral ratio between 1 and 2.5. When this ratio exceeds 3, it indicates a higher percentage of tri or tetra substituted olefins being present, thus other assumptions known in the analytical art can be made to calculate the number of double bonds in the sample. The steps are as follows: A) Prepare a solution of 5-10% of the test hydrocarbon in deuterochloroform. B) Acquire a normal proton spectrum of at least 12 ppm spectral width and accurately reference the chemical shift (ppm) axis, with the instrument having sufficient gain range to acquire a signal without overloading the receiver/ADC, e.g., when a 30 degree pulse is applied, the instrument having a minimum signal digitization dynamic range of 65,000. In one embodiment, the instrument has a dynamic range of at least 260,000. C) Measure the integral intensities between: 6.0-4.5 ppm (olefin); 2.2-1.9 ppm (allylic); and 1.9-0.5 ppm (saturate). D) Using the molecular weight of the test substance determined by ASTM D 2503-92 (Reapproved 2002), calculate: 1. The average molecular formula of the saturated hydrocarbons; 2. The average molecular formula of the olefins; 3. The total integral intensity (=sum of all integral intensities); 4. The integral intensity per sample hydrogen (=total integral/number of hydrogens in formula); 5. The number of olefin hydrogens (=Olefin integral/integral per hydrogen); 6. The number of double bonds (=Olefin hydrogen times hydrogens in olefin formula/2); and 7. The wt % olefins by proton NMR=100 times the number of double bonds times the number of hydrogens in a typical olefin molecule divided by the number of hydrogens in a typical test substance molecule. In this test, the wt % olefins by proton NMR calculation procedure, D, works particularly well when the percent olefins result is low, less than 15 wt %.

Weight percent aromatics in one embodiment can be measured by HPLC-UV. In one embodiment, the test is conducted using a Hewlett Packard 1050 Series Quaternary Gradient High Performance Liquid Chromatography (HPLC) system, coupled with a HP 1050 Diode-Array UV-Vis detector interfaced to an HP Chem-station. Identification of the individual aromatic classes in the highly saturated base oil can be made on the basis of the UV spectral pattern and the elution time. The amino column used for this analysis differentiates aromatic molecules largely on the basis of their ring-number (or double-bond number). Thus, the single ring aromatic containing molecules elute first, followed by the polycyclic aromatics in order of increasing double bond number per molecule. For aromatics with similar double bond character, those with only alkyl substitution on the ring elute sooner than those with naphthenic substitution. Unequivocal identification of the various base oil aromatic hydrocarbons from their UV absorbance spectra can be accomplished recognizing that their peak electronic transitions are all red-shifted relative to the pure model compound analogs to a degree dependent on the amount of alkyl and naphthenic substitution on the ring system. Quantification of the eluting aromatic compounds can be made by integrating chromatograms made from wavelengths optimized for each general class of compounds over the appropriate retention time window for that aromatic. Retention time window limits for each aromatic class can be determined by manually evaluating the individual absorbance spectra of eluting compounds at different times and assigning them to the appropriate aromatic class based on their qualitative similarity to model compound absorption spectra.

HPLC-UV Calibration. In one embodiment, HPLC-UV can be used for identifying classes of aromatic compounds even at very low levels, e.g., multi-ring aromatics typically absorb 10 to 200 times more strongly than single-ring aromatics. Alkyl-substitution affects absorption by 20%. Integration limits for the co-eluting 1-ring and 2-ring aromatics at 272 nm can be made by the perpendicular drop method. Wavelength dependent response factors for each general aromatic class can be first determined by constructing Beer's Law plots from pure model compound mixtures based on the nearest spectral peak absorbances to the substituted aromatic analogs. Weight percent concentrations of aromatics can be calculated by assuming that the average molecular weight for each aromatic class was approximately equal to the average molecular weight for the whole base oil sample.

NMR analysis. In one embodiment, the weight percent of all molecules with at least one aromatic function in the purified mono-aromatic standard can be confirmed via long-duration carbon 13 NMR analysis. The NMR results can be translated from % aromatic carbon to % aromatic molecules (to be consistent with HPLC-UV and D 2007) knowing that 95-99% of the aromatics in highly saturated base oils are single-ring aromatics. In another test to accurately measure low levels of all molecules with at least one aromatic function by NMR, the standard D 5292-99 (Reapproved 2004) method can be modified to give a minimum carbon sensitivity of 500:1 (by ASTM standard practice E 386) with a 15-hour duration run on a 400-500 MHz NMR with a 10-12 mm Nalorac probe. Acorn PC integration software can be used to define the shape of the baseline and consistently integrate.

Extent of branching refers to the number of alkyl branches in hydrocarbons. Branching and branching position can be determined using carbon-13 ($^{13}C$) NMR according to the following nine-step process: 1) Identify the CH branch centers and the $CH_3$ branch termination points using the DEPT Pulse sequence (Doddrell, D. T.; D. T. Pegg; M. R. Bendall, *Journal of Magnetic Resonance* 1982, 48, 323ff.). 2) Verify the absence of carbons initiating multiple branches (quaternary carbons) using the APT pulse sequence (Patt, S. L.; J. N. Shoolery, *Journal of Magnetic Resonance* 1982, 46, 535ff.). 3) Assign the various branch carbon resonances to specific branch positions and lengths using tabulated and calculated values known in the art (Lindeman, L. P., *Journal of Qualitative Analytical Chemistry* 43, 1971 1245ff, Netzel, D. A., et. al., *Fuel,* 60, 1981, 307ff). 4) Estimate relative branching density at different carbon positions by comparing the integrated intensity of the specific carbon of the methyl/alkyl group to the intensity of a single carbon (which is equal to total integral/number of carbons per molecule in the mixture). For the 2-methyl branch, where both the terminal and the branch methyl occur at the same resonance position, the intensity is divided by two before estimating the branching density. If the 4-methyl branch fraction is calculated and tabulated, its contribution to the 4+methyls is subtracted to avoid double counting. 5) Calculate the average carbon number. The average carbon number is determined by dividing the molecular weight of the sample by 14 (the formula weight of $CH_2$). 6) The number of branches per molecule is the sum of the branches found in step 4. 7) The number of alkyl branches per 100 carbon atoms is calculated from the number of branches per molecule (step 6) times 100/average carbon number. 8) Estimate Branching Index (BI) by $^{1}H$ NMR Analysis, which is presented as percentage of methyl hydrogen (chemical shift range 0.6-1.05 ppm) among total hydrogen as estimated by NMR in the liquid hydrocarbon composition. 9) Estimate Branching proximity (BP) by $^{13}C$ NMR, which is presented as percentage of recurring methylene carbons—which are four or more carbons away from the end group or a branch (represented by a NMR signal at 29.9 ppm) among total carbons as estimated by NMR in the liquid hydrocarbon composition. The measurements can be performed using any Fourier Transform NMR spectrometer, e.g., one having a magnet of 7.0 T or greater. After verification by Mass Spectrometry, UV or an NMR survey that aromatic carbons are absent, the spectral width for the $^{13}C$ NMR studies can be limited to the saturated carbon region, 0-80 ppm vs. TMS (tetramethylsilane). Solutions of 25-50 wt. % in chloroform-d1 are excited by 30 degrees pulses followed by a 1.3 seconds (sec.) acquisition time. In order to minimize non-uniform intensity data, the broadband proton inverse-gated decoupling is used during a 6 sec. delay prior to the excitation pulse and on during acquisition. Samples are doped with 0.03 to 0.05 M Cr $(acac)_3$ (tris(acetylacetonato)-chromium (III)) as a relaxation agent to ensure full intensities are observed. The DEPT and APT sequences can be carried out according to literature descriptions with minor deviations described in the Varian or Bruker operating manuals. DEPT is Distortionless Enhancement by Polarization Transfer. The DEPT 45 sequence gives a signal all carbons bonded to protons. DEPT 90 shows CH carbons only. DEPT 135 shows CH and $CH_3$ up and $CH_2$ 180 degrees out of phase (down). APT is attached proton test, known in the art. It allows all carbons to be seen, but if CH and $CH_3$ are up, then quaternaries and $CH_2$ are down. The branching properties of the sample can be determined by $^{13}C$ NMR using the assumption in the calculations that the entire sample was iso-paraffinic. The unsaturates content may be measured using Field Ionization Mass Spectroscopy (FIMS).

In one embodiment, the hydraulic fluid composition comprises 0.001-20 wt. % optional additives in a matrix of base oil or base oil blends in an amount of 80 to 99.999 wt. % based on the total weight of the composition.

Base Oil Component: In one embodiment, the matrix of base oil or blends thereof comprises at least an isomerized base oil which the product itself, its fraction, or feed originates from or is produced at some stage by isomerization of a waxy feed from a Fischer-Tropsch process ("Fischer-Tropsch derived base oils"). In another embodiment, the base oil comprises at least an isomerized base oil made from a substantially paraffinic wax feed ("waxy feed").

Fischer-Tropsch derived base oils are disclosed in a number of patent publications, including for example U.S. Pat. Nos. 6,080,301, 6,090,989, and 6,165,949, and US Patent Publication No. US2004/0079678A1, US20050133409, US20060289337. Fischer-Tropsch process is a catalyzed chemical reaction in which carbon monoxide and hydrogen are converted into liquid hydrocarbons of various forms including a light reaction product and a waxy reaction product, with both being substantially paraffinic.

In one embodiment the isomerized base oil has consecutive numbers of carbon atoms and has less than 10 wt % naphthenic carbon by n-d-M. In yet another embodiment the isomerized base oil made from a waxy feed has a kinematic viscosity at 100° C. between 1.5 and 3.5 $mm^2/s$.

In one embodiment, the isomerized base oil is made by a process in which the hydroisomerization dewaxing is performed at conditions sufficient for the base oil to have: a) a weight percent of all molecules with at least one aromatic functionality less than 0.30; b) a weight percent of all molecules with at least one cycloparaffinic functionality greater than 10; c) a ratio of weight percent molecules with monocycloparaffinic functionality to weight percent molecules with multicycloparaffinic functionality greater than 20 and d) a viscosity index greater than 28×Ln (Kinematic viscosity at 100° C.)+80.

In another embodiment, the isomerized base oil is made from a process in which the highly paraffinic wax is hydroisomerized using a shape selective intermediate pore size molecular sieve comprising a noble metal hydrogenation component, and under conditions of 600-750° F. (315-399° C.) In the process, the conditions for hydroisomerization are controlled such that the conversion of the compounds boiling above 700° F. (371° C.) in the wax feed to compounds boiling below 700° F. (371° C.) is maintained between 10 wt % and 50 wt %. A resulting isomerized base oil has a kinematic viscosity of between 1.0 and 3.5 $mm^2/s$ at 100° C. and a Noack volatility of less than 50 weight %. The base oil comprises greater than 3 weight % molecules with cycloparaffinic functionality and less than 0.30 weight percent aromatics.

In one embodiment the isomerized base oil has a Noack volatility less than an amount calculated by the following equation: 1000×(Kinematic Viscosity at 100° C.)$^{-2.7}$. In another embodiment, the isomerized base oil has a Noack volatility less than an amount calculated by the following equation: 900×(Kinematic Viscosity at 100° C.)$^{-2.8}$. In a third embodiment, the isomerized base oil has a Kinematic Viscosity at 100° C. of >1.808 mm$^2$/s and a Noack volatility less than an amount calculated by the following equation: 1.286+20 (kv100)$^{-1.5}$+551.8 $e^{-kv100}$, where kv100 is the kinematic viscosity at 100° C. In a fourth embodiment, the isomerized base oil has a kinematic viscosity at 100° C. of less than 4.0 mm$^2$/s, and a wt % Noack volatility between 0 and 100. In a fifth embodiment, the isomerized base oil has a kinematic viscosity between 1.5 and 4.0 mm$^2$/s and a Noack volatility less than the Noack volatility calculated by the following equation: 160-40 (Kinematic Viscosity at 100° C.).

In one embodiment, the isomerized base oil has a kinematic viscosity at 100° C. in the range of 2.4 and 3.8 mm$^2$/s and a Noack volatility less than an amount defined by the equation: 900×(Kinematic Viscosity at 100° C.)$^{-2.8}$−15). For kinematic viscosities in the range of 2.4 and 3.8 mm$^2$/s, the equation: 900×(Kinematic Viscosity at 100° C.)$^{-2.8}$−15) provides a lower Noack volatility than the equation: 160-40 (Kinematic Viscosity at 100° C.).

In one embodiment, the isomerized base oil is made from a process in which the highly paraffinic wax is hydroisomerized under conditions for the base oil to have a kinematic viscosity at 100° C. of 3.6 to 4.2 mm$^2$/s, a viscosity index of greater than 130, a wt % Noack volatility less than 12, a pour point of less than −9° C.

In one embodiment, the isomerized base oil has an aniline point, in degrees F., greater than 200 and less than or equal to an amount defined by the equation: 36×Ln(Kinematic Viscosity at 100° C., in mm$^2$/s)+200.

In one embodiment, the isomerized base oil has an autoignition temperature (AIT) greater than the AIT defined by the equation: AIT in ° C.=1.6×(Kinematic Viscosity at 40° C., in mm2/s)+300. In a second embodiment, the base oil as an AIT of greater than 329° C. and a viscosity index greater than 28×Ln (Kinematic Viscosity at 100° C., in mm$^2$/s)+100.

In one embodiment, the isomerized base oil has a relatively low traction coefficient, specifically, its traction coefficient is less than an amount calculated by the equation: traction coefficient=0.009×Ln (kinematic viscosity in mm$^2$/s)−0.001, wherein the kinematic viscosity in the equation is the kinematic viscosity during the traction coefficient measurement and is between 2 and 50 mm$^2$/s. In one embodiment, the isomerized base oil has a traction coefficient of less than 0.023 (or less than 0.021) when measured at a kinematic viscosity of 15 mm$^2$/s and at a slide to roll ratio of 40%. In another embodiment the isomerized base oil has a traction coefficient of less than 0.017 when measured at a kinematic viscosity of 15 mm$^2$/s and at a slide to roll ratio of 40%. In another embodiment the isomerized base oil has a viscosity index greater than 150 and a traction coefficient less than 0.015 when measured at a kinematic viscosity of 15 mm$^2$/s and at a slide to roll ratio of 40 percent.

In some embodiments, the isomerized base oil having low traction coefficients also displays a higher kinematic viscosity and higher boiling points. In one embodiment, the base oil has a traction coefficient less than 0.015, and a 50 wt % boiling point greater than 565° C. (1050° F.). In another embodiment, the base oil has a traction coefficient less than 0.011 and a 50 wt % boiling point by ASTM D 6352-04 greater than 582° C. (1080° F.).

In some embodiments, the isomerized base oil having low traction coefficients also displays unique branching properties by NMR, including a branching index less than or equal to 23.4, a branching proximity greater than or equal to 22.0, and a Free Carbon Index between 9 and 30. In one embodiment, the base oil has at least 4 wt % naphthenic carbon, in another embodiment, at least 5 wt % naphthenic carbon by n-d-M analysis by ASTM D 3238-95 (Reapproved 2005).

In one embodiment, the isomerized base oil is produced in a process wherein the intermediate oil isomerate comprises paraffinic hydrocarbon components, and in which the extent of branching is less than 7 alkyl branches per 100 carbons, and wherein the base oil comprises paraffinic hydrocarbon components in which the extent of branching is less than 8 alkyl branches per 100 carbons and less than 20 wt % of the alkyl branches are at the 2 position. In one embodiment, the FT base oil has a pour point of less than −8° C.; a kinematic viscosity at 100° C. of at least 3.2 mm$^2$/s; and a viscosity index greater than a viscosity index calculated by the equation of =22×Ln (kinematic viscosity at 100° C.)+132.

In one embodiment, the base oil comprises greater than 10 wt. % and less than 70 wt. % total molecules with cycloparaffinic functionality, and a ratio of weight percent molecules with monocycloparaffinic functionality to weight percent molecules with multicycloparaffinic functionality greater than 15.

In one embodiment, the isomerized base oil has an average molecular weight between 600 and 1100, and an average degree of branching in the molecules between 6.5 and 10 alkyl branches per 100 carbon atoms. In another embodiment, the isomerized base oil has a kinematic viscosity between about 8 and about 25 mm$^2$/s and an average degree of branching in the molecules between 6.5 and 10 alkyl branches per 100 carbon atoms.

In one embodiment, the isomerized base oil is obtained from a process in which the highly paraffinic wax is hydroisomerized at a hydrogen to feed ratio from 712.4 to 3562 liter $H_2$/liter oil, for the base oil to have a total weight percent of molecules with cycloparaffinic functionality of greater than 10, and a ratio of weight percent molecules with monocycloparaffinic functionality to weight percent molecules with multicycloparaffinic functionality of greater than 15. In another embodiment, the base oil has a viscosity index greater than an amount defined by the equation: 28×Ln (Kinematic viscosity at 100° C.)+95. In a third embodiment, the base oil comprises a weight percent aromatics less than 0.30; a weight percent of molecules with cycloparaffinic functionality greater than 10; a ratio of weight percent of molecules with monocycloparaffinic functionality to weight percent of molecules with multicycloparaffinic functionality greater than 20; and a viscosity index greater than 28×Ln (Kinematic Viscosity at 100° C.)+110. In a fourth embodiment, the base oil further has a kinematic viscosity at 100° C. greater than 6 mm$^2$/s. In a fifth embodiment, the base oil has a weight percent aromatics less than 0.05 and a viscosity index greater than 28×Ln (Kinematic Viscosity at 100° C.)+95. In a sixth embodiment, the base oil has a weight percent aromatics less than 0.30, a weight percent molecules with cycloparaffinic functionality greater than the kinematic viscosity at 100° C., in mm$^2$/s, multiplied by three, and a ratio of molecules with monocycloparaffinic functionality to molecules with multicycloparaffinic functionality greater than 15.

In one embodiment, the isomerized base oil contains between 2 and 10% naphthenic carbon as measured by n-d-M. In one embodiment, the base oil has a kinematic viscosity of 1.5-3.0 $mm^2/s$ at 100° C. and 2-3% naphthenic carbon. In another embodiment, a kinematic viscosity of 1.8-3.5 $mm^2/s$ at 100° C. and 2.5-4% naphthenic carbon. In a third embodiment, a kinematic viscosity of 3-6 $mm^2/s$ at 100° C. and 2.7-5% naphthenic carbon. In a fourth embodiment, a kinematic viscosity of 10-30 $mm^2/s$ at 100° C. and greater than 5.2% naphthenic carbon.

In one embodiment, the isomerized base oil has an average molecular weight greater than 475; a viscosity index greater than 140, and a weight percent olefins less than 10. The base oil improves the air release and low foaming characteristics of the mixture when incorporated into the hydraulic fluid composition.

In one embodiment, the isomerized base oil is a white oil as disclosed in U.S. Pat. No. 7,214,307 and US Patent Publication US20060016724. In one embodiment, the isomerized base oil has a kinematic viscosity at 100° C. between about 1.5 cSt and 36 $mm^2/s$, a viscosity index greater than an amount calculated by the equation: Viscosity Index=28×Ln (the Kinematic Viscosity at 100° C.)+95, between 5 and less than 18 weight percent molecules with cycloparaffinic functionality, less than 1.2 weight percent molecules with multicycloparaffinic functionality, a pour point less than 0° C. and a Saybolt color of +20 or greater.

In one embodiment, the hydraulic composition employs a base oil that consists of at least one of the isomerized base oils described above. In another embodiment, the composition consists essentially of at least a Fischer-Tropsch base oil. In yet another embodiment, the base oil matrix employs at least a Fischer-Tropsch base oil and optionally 5 to 95 wt. % (based on the weight of the base oil matrix) of at least another type of oil, e.g., lubricant base oils selected from Group I, II, III, IV, and V lubricant base oils as defined in the API Interchange Guidelines, and mixtures thereof. Examples include conventionally used mineral oils, synthetic hydrocarbon oils or synthetic ester oils, or mixtures thereof depending on the application. Mineral lubricating oil base stocks can be any conventionally refined base stocks derived from paraffinic, naphthenic and mixed base crudes. Synthetic lubricating oils that can be used include esters of glycols and complex esters. Other synthetic oils that can be used include synthetic hydrocarbons such as polyalphaolefins; alkyl benzenes, e.g., alkylate bottoms from the alkylation of benzene with tetrapropylene, or the copolymers of ethylene and propylene; silicone oils, e.g., ethyl phenyl polysiloxanes, methyl polysiloxanes, etc., polyglycol oils, e.g., those obtained by condensing butyl alcohol with propylene oxide; etc. Other suitable synthetic oils include the polyphenyl ethers, e.g., those having from 3 to 7 ether linkages and 4 to 8 phenyl groups. Other suitable synthetic oils include polyisobutenes, and alkylated aromatics such as alkylated naphthalenes.

In one embodiment, the isomerized base oil is a FT base oil having a kinematic viscosity at 100° C. between 6 $mm^2/s$ and 20 $mm^2/s$; a kinematic viscosity at 40° C. between 30 $mm^2/s$ and 120 $mm^2/s$; a viscosity index between 150 and 165; Cold crank viscosity in the range of 3,000-50,000 mPa·s at −30° C., 2,000-20,000 mPa·s at −25° C.; pour point in the range of −2 and −20° C.; molecular weight of 500-750; density in the range of 0.820 to 0.840; paraffinic carbon in the range of 92-95%; naphthenic carbon in the range of 5-8%; Oxidator BN of 30 to 50 hours; and Noack volatility in wt. % of 0.50 to 5.

In one embodiment, the isomerized base oil has less between 0.001 to 0.05 wt. % aromatics and a molecular weight of greater than 600 by ASTM D 2503-92 (Reapproved 2002), and 0 to 0.10 wt. % olefins. In another embodiment, the isomerized base oil has a molecular weight of greater than 650. In a third embodiment, the isomerized base oil has a wt % total molecules with cycloparaffinic functionality greater than 25 and a ratio of molecules with monocycloparaffinic functionality to molecules with multicycloparaffinic functionality greater than 10.

Additional Components: The hydraulic fluid composition is characterized as having minimal effect on seals even with little or no seal swell additive added. In one embodiment, seal swell additive can be optionally added in a reduced amount of 0.01 to 1 wt. % as compared to the prior art levels. In another embodiment, the level of seal swell additives is less than 0.5 wt. %. Examples of optional seal swell agents known in the art include but are not limited to dioctylphthalate, tertiary diamide, dioctyl sebacate, polyol esters, branched chain carboxylic esters and mixtures thereof.

In one embodiment, the hydraulic fluid composition further comprises 0.001 to 6 wt. %. of at least a viscosity index modifier. In one embodiment, the viscosity index modifiers used is a mixture of modifiers selected from polyacrylate or polymethacrylate and polymers, comprising vinyl aromatic units and esterified carboxyl-containing units. In one embodiment, the first viscosity modifier is a polyacrylate or polymethacrylate having an average molecular weight of 10,000 to 60,000. In another embodiment, the second viscosity modifier comprises vinyl aromatic units and esterified carboxyl-containing units, having an average molecular weight of 100,000 to 200,000.

In another embodiment, the viscosity modifier is a blend of a polymethacrylate viscosity index improver having a weight average molecular weight of 25,000 to 150,000 and a shear stability index less than 5 and a polymethacrylate viscosity index improver having a weight average molecular weight of 500,000 to 1,000,000 and a shear stability index of 25 to 60. In yet another embodiment, the viscosity modifier is selected from the group of polymethacrylate type polymers, ethylene-propylene copolymers, styrene-isoprene copolymers, hydrated styrene-isoprene copolymers, polyisobutylene, and mixtures thereof.

In one embodiment, the hydraulic fluid further comprises at least a surfactant, or also known as a dispersant, which can be generally classified as anionic, cationic, zwitterionic, or non-ionic. In some embodiments a dispersant may be used alone or in combination of one or more species or types of dispersants. Examples include an oil-soluble dispersant selected from the group consisting of succinimide dispersants, succinic ester dispersants, succinic ester-amide dispersant, Mannich base dispersant, phosphorylated forms thereof, and boronated forms thereof. The dispersants may be capped with acidic molecules capable of reacting with secondary amino groups. The molecular weight of the hydrocarbyl groups may range from 600 to 3000, for example from 750 to 2500, and as a further example from 900 to 1500. In one embodiment, the dispersant is selected from the group of alkenyl succinimides, alkenyl succinimides modified with other organic compounds, alkenyl succinimides modified by post-treatment with ethylene carbonate or boric acid, pentaerythritols, phenate-salicylates and their post-treated analogs, alkali metal or mixed alkali metal, alkaline earth metal borates, dispersions of hydrated alkali metal borates, dispersions of alkaline-earth metal borates, polyamide ashless dispersants and the like or mixtures of such dispersants.

In some embodiments, the ashless dispersant may include the products of the reaction of a polyethylene polyamine, e.g., triethylene tetramine or tetraethylene pentamine, with a hydrocarbon substituted carboxylic acid or anhydride made by reaction of a polyolefin, such as polyisobutene, of suitable molecular weight, with an unsaturated polycarboxylic acid or anhydride, e.g., maleic anhydride, maleic acid, fumaric acid, or the like, including mixtures of two or more such substances. In another embodiment, the ashless dispersant is a borated dispersant. Borated dispersants may be formed by boronating (borating) an ashless dispersant having basic nitrogen and/or at least one hydroxyl group in the molecule, such as a succinimide dispersant, succinamide dispersant, succinic ester dispersant, succinic ester-amide dispersant, Mannich base dispersant, or hydrocarbyl amine or polyamine dispersant.

In one embodiment, the hydraulic fluid further comprises one or more metallic detergents. Examples of metallic detergent include an oil-soluble neutral or overbased salt of alkali or alkaline earth metal with one or more of the following acidic substances (or mixtures thereof): (1) a sulfonic acid, (2) a carboxylic acid, (3) a salicylic acid, (4) an alkyl phenol, (5) a sulfurized alkyl phenol, and (6) an organic phosphorus acid characterized by at least one direct carbon-to-phosphorus linkage, such as a phosphonate. Such an organic phosphorus acid may include those prepared by the treatment of an olefin polymer (e.g., polyisobutylene having a molecular weight of 1,000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. In yet another embodiment, the metallic detergent is selected from the group of sulfurized or unsulfurized alkyl or alkenyl phenates, alkyl or alkenyl aromatic sulfonates, borated sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof.

In one embodiment, the hydraulic fluid further comprises at least a corrosion inhibitor selected from thiazoles, triazoles, and thiadiazoles. Examples of such compounds include benzotriazole, tolyltriazole, octyltriazole, decyltriazole, dodecyltriazole, 2-mercapto benzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis (hydrocarbyldithio)-1,3,4-thiadiazoles. Suitable compounds include the 1,3,4-thiadiazoles, a number of which are available as articles of commerce, and also combinations of triazoles such as tolyltriazole with a 1,3,5-thiadiazole such as a 2,5-bis(alkyldithio)-1,3,4-thiadiazole. The 1,3,4-thiadiazoles are generally synthesized from hydrazine and carbon disulfide by known procedures. See, for example, U.S. Pat. Nos. 2,765,289; 2,749,311; 2,760,933; 2,850,453; 2,910,439; 3,663,561; 3,862,798; and 3,840,549.

In one embodiment, the hydraulic fluid composition further includes rust or corrosion inhibitors selected from the group of monocarboxylic acids and polycarboxylic acids. Examples of suitable monocarboxylic acids are octanoic acid, decanoic acid and dodecanoic acid. Suitable polycarboxylic acids include dimer and trimer acids such as are produced from such acids as tall oil fatty acids, oleic acid, linoleic acid, or the like. Another useful type of rust inhibitor may comprise alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable rust or corrosion inhibitors include ether amines; acid phosphates; amines; polyethoxylated compounds such as ethoxylated amines, ethoxylated phenols, and ethoxylated alcohols; imidazolines; aminosuccinic acids or derivatives thereof, and the like. Mixtures of such rust or corrosion inhibitors can be used. Other examples of rust inhibitors include a polyethoxylated phenol, neutral calcium sulfonate and basic calcium sulfonate.

In one embodiment, the hydraulic fluid further comprise at least a friction modifier selected from the group of succinimide, a bis-succinimide, an alkylated fatty amine, an ethoxylated fatty amine, an amide, a glycerol ester, an imidazoline, fatty alcohol, fatty acid, amine, borated ester, other esters, phosphates, phosphites, phosphonates, and mixtures thereof.

In one embodiment, the hydraulic fluid composition further comprises at least an antiwear additive. Examples of such agents include, but are not limited to, phosphates, carbamates, esters, and molybdenum complexes. In one embodiment, the antiwear additive is selected from the group of a zinc dialkyl dithio phosphate (ZDDP), an alkyl phosphite, a trialkyl phosphite, and amine salts of dialkyl and mono-alkyl phosphoric acid.

In one embodiment, the composition may further comprise at least an antioxidant selected from the group of phenolic antioxidants, aromatic amine antioxidants, sulfurized phenolic antioxidants, and organic phosphites, among others. Examples of phenolic antioxidants include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl6-tert-butylphenol), mixed methylene-bridged polyalkyl phenols, 4,4'-thiobis(2-methyl-6-tert-butylphenol), 4,4'-butylidene-bis(3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,6-di-tert-butyl-4-methylphenol, 2,6-di-tert-butyl-4-ethylphenol, 2,4-dimethyl-6-tert-butyl-phenol, 2,6-di-tert-1-dimethylamino-p-cresol, 2,6-di-tert-4-(N,N'-dimethylaminomethylphenol), 4,4'-thiobis(2-methyl-6-tert-butylphenol), 2,2'-thiobis(4-methyl-6-tert-butylphenol), bis (3-methyl-4-hydroxy-5-tert-10-butylbenzyl)-sulfide, bis(3,5-di-tert-butyl-4-hydroxybenzyl), 2,2'-5-methylene-bis(4-methyl-6-cyclohexylphenol), N,N'-di-sec-butyl-phenylenediamine, 4-isopropylaminodiphenylamine, phenyl-.alpha.-naphthyl amine, phenyl-.alpha.-naphthyl amine, and ring-alkylated diphenylamines. Examples include the sterically hindered tertiary butylated phenols, bisphenols and cinnamic acid derivatives and combinations thereof. In yet another embodiment, the antioxidant is an organic phosphonate having at least one direct carbon-to-phosphorus linkage. Diphenylamine-type oxidation inhibitors include, but are not limited to, alkylated diphenylamine, phenyl-alpha-naphthylamine, and alkylated-alpha-naphthylamine. Other types of oxidation inhibitors include metal dithiocarbamate (e.g., zinc dithiocarbamate), and 15-methylenebis(dibutyldithiocarbamate).

In one embodiment, the hydraulic fluid optionally comprises a sufficient amount of pour point depressant to cause the pour point of the hydraulic fluid to be at least 3° C. below the pour point of a blend that does not have the pour point depressant. Pour point depressants are known in the art and include, but are not limited to esters of maleic anhydride-styrene copolymers, polymethacrylates, polyacrylates, polyacrylamides, condensation products of haloparaffin waxes and aromatic compounds, vinyl carboxylate polymers, and terpolymers of dialkylfumarates, vinyl esters of fatty acids, ethylene-vinyl acetate copolymers, alkyl phenol formaldehyde condensation resins, alkyl vinyl ethers, olefin copolymers, and mixtures thereof.

In one embodiment, the pour point depressant is a pour point reducing blend component. In one embodiment, the pour point reducing blend component pour point depressant is an isomerized Fischer-Tropsch derived vacuum distillation bottoms product, which is a high boiling syncrude fraction which has been isomerized under controlled conditions to give a specified degree of alkyl branching in the molecule. Syncrude prepared from the Fischer-Tropsch process comprises a mixture of various solid, liquid, and gaseous hydrocarbons. When the Fischer-Tropsch waxes are converted into Fischer-Tropsch base oils by various processes, such as by hydroprocessing and distillation, the base oils produced fall into different narrow-cut viscosity ranges. The bottoms that remains after recovering the lubricating base oil cuts from the vacuum column is generally unsuitable for use as a lubricating base oil itself and is usually recycled to a hydrocracking unit for conversion to lower molecular weight products.

In one embodiment, the pour point reducing blend component is an isomerized Fischer-Tropsch derived vacuum distillation bottoms product having an average molecular weight between 600 and 1100 and an average degree of branching in the molecules between 6.5 and 10 alkyl branches per 100 carbon atoms. Generally, the higher molecular weight hydrocarbons are more effective as pour point reducing blend components than the lower molecular weight hydrocarbons. In one embodiment, a higher cut point in a vacuum distillation unit which results in a higher boiling bottoms material is used to prepare the pour point reducing blend component. The higher cut point also has the advantage of resulting in a higher yield of the distillate base oil fractions. In one embodiment, the pour point reducing blend component is an isomerized Fischer-Tropsch derived vacuum distillation bottoms product having a pour point that is at least 3° C. higher than the pour point of the distillate base oil it is blended with.

In one embodiment, the 10 percent point of the boiling range of the pour point reducing blend component that is a vacuum distillation bottoms product is between about 850° F.-1050° F. (454-565° C.). In another embodiment, the pour point reducing blend component is derived from either Fischer-Tropsch or petroleum products, having a boiling range above 950° F. (510° C.), and contains at least 50 percent by weight of paraffins. In yet another embodiment the pour point reducing blend component has a boiling range above 1050° F. (565° C.)

In another embodiment, the pour point reducing blend component is an isomerized petroleum derived base oil containing material having a boiling range above about 1050° F. In one embodiment, the isomerized bottoms material is solvent dewaxed prior to being used as a pour point reducing blend component. The waxy product further separated during solvent dewaxing from the pour point reducing blend component were found to display excellent improved pour point depressing properties compared to the oily product recovered after the solvent dewaxing.

In one embodiment, the pour point reducing blend component has an average degree of branching in the molecules within the range of from 6.5 to 10 alkyl branches per 100 carbon atoms. In another embodiment, the pour point reducing blend component has an average molecular weight between 600-11100. In a third embodiment, between 700-1000. In one embodiment, the pour point reducing blend component has a kinematic viscosity at 100° C. of 8-30 $mm^2/s$, with the 10% point of the boiling range of the bottoms falling between about 850-1050° F. In yet another embodiment, the pour point reducing blend component has a kinematic viscosity at 100° C. of 15-20 $mm^2/s$ and a pour point of −8 to −12° C.

In another embodiment, the pour point reducing blend component is an isomerized oil having a kinematic viscosity at 100° C. of at least about 8 $mm^2/s$ made from polyethylene plastic. In another embodiment, the pour point reducing blend component is made from waste plastic. In yet another embodiment the pour point reducing blend component is made from a process comprising: pyrolysis of polyethylene plastic, separating out a heavy fraction, hydrotreating the heavy fraction, catalytic isomerizing the hydrotreated heavy fraction, and collecting the pour point reducing blend component having a kinematic viscosity at 100° C. of at least about 8 $mm^2/s$. In one embodiment, the pour point reducing blend component derived from polyethylene plastic has a boiling range above 1050° F. (565° C.), or even a boiling range above 1200° F. (649° C.).

In one embodiment, the hydraulic fluid further comprises at least an extreme pressure anti-wear agent (EP/AW Agent). Examples include zinc dialky-1-dithiophosphate (primary alkyl, secondary alkyl, and aryl type), diphenyl sulfide, methyl trichlorostearate, chlorinated naphthalene, fluoroalkylpolysiloxane, lead naphthenate, neutralized phosphates, dithiophosphates, and sulfur-free phosphates.

The hydraulic fluid may also include conventional additives in addition to those described above. Examples include but are not limited to colorants, metal deactivators such as disalicylidene propylenediamine, triazole derivatives, thiadiazole derivatives, and mercaptobenzimidazoles, antifoam and defoamer additives such as alkyl methacrylate polymers and dimethyl silicone polymers, and/or air expulsion additives. Such additives may be added to provide, for example, viscometric multigrade functionality.

In one embodiment, the additional components are added as a fully formulated additive package fully formulated to meet an original equipment manufacturer's requirements for a hydraulic fluid, e.g., giving the fluid the capacity to meet bench and dynamometer tests. The package to be used depends in part by the requirements of the specific equipment to receive the lubricant composition. Examples of additives and additive packages that have been used in hydraulic fluids are disclosed in U.S. Pat. Nos. 5,635,459 and 5,843,873. In one embodiment, the additive package comprises among other materials, metal-containing detergents, such as 12% (e.g. 1.41%) of a calcium-overbased sulfonate detergent; antioxidants or anti-wear agents, such as 12% (e.g., 1.69%) of a zinc dialkyldithiophosphate; 0.5 to 2% (e.g. 1.03%) of friction modifiers; and 0.1 to 2% (e.g., 0.25%) of a nitrogen-containing dispersant such as succinimide dispersants. Other conventional components may also be present, if desired.

Method for Making: Additives used in formulating the hydraulic fluid composition can be blended into the base oil matrix individually or in various sub-combinations to subsequently form the hydraulic fluid. In one embodiment, all of the components are blended concurrently using an additive concentrate (i.e., additives plus a diluent, such as a hydrocarbon solvent). The use of an additive concentrate takes advantage of the mutual compatibility afforded by the combination of ingredients when in the form of an additive concentrate.

In another embodiment, the hydraulic fluid composition is prepared by mixing the base oil matrix with the separate additives or additive package(s) at an appropriate temperature, such as approximately 60° C., until homogeneous.

Properties: The isomerized base oil when used in the hydraulic fluid composition provides seal swelling (a change in volume) and conditioning of elastomeric seals of the type normally used to seal hydraulic systems, when tested in accordance with ASTM D 471-06, Standard Method for Rubber Property-Effect of Liquids. In one embodiment, the hydraulic fluid composition is characterized as resulting in an average volume change (swell increase) in a rubber seal of −0.50% to less than 3%, and an average hardness change in the rubber seal of less than 1 pts. when tested under ASTM D 471-06 (SRE NBR1 at 100° C., 168 hours). In another embodiment, the composition results in an average rubber seal volume change from −0.30% to less than 2% and an average hardness change of less than 0.50 pts. In a third embodiment, the hydraulic fluid composition results in an average volume change in a rubber seal of less than 1.75% and an average hardness change in the rubber seal of less than 0.3 pts. when tested under ASTM D 471-06 (SRE NBR1 at 100° C., 168 hours).

In one embodiment, the hydraulic fluid composition is characterized as being very stable for use with a wide range of temperatures with a viscosity index (VI) of at least 140. In another embodiment, the hydraulic fluid has a VI of at least 150. In a third embodiment, a VI of at least 160.

In one embodiment, the hydraulic fluid composition is characterized as being particularly suitable for use in applications demanding the use of fire resistant fluids, e.g., electrohydraulic control for driving electric generators in a power plant with a flash point of at least 270° C. In a second embodiment, the hydraulic fluid has a flash point of at least 280° C. In one embodiment, the hydraulic fluid composition has an autoignition temperature of at least 360° C.

In one embodiment, the hydraulic fluid composition is characterized as having exceptionally low volatility, with an evaporation loss of less than 1 mass % after 22 hours at 149° C., as measured according to ASTM D972-02, thus requiring less make-up requirements when in use in operations. In another embodiment, the composition shows an evaporation loss of less than 0.5 mass % (per ASTM D972-02, 22 hours at 149° C.).

In one embodiment, a hydraulic fluid composition having a base oil matrix consisting essentially of an isomerized base oil such as a Fischer-Tropsch derived base oil shows OECD 301D levels ranging from inherently biodegradable of >30% to readily biodegradable of >90%. In one embodiment, a hydraulic fluid composition with a base oil matrix having a kinematic viscosity at 40° C. of <100 $mm^2/s$ (H) exhibits an OECD 301D biodegradability of about 30%. In a second embodiment, the hydraulic fluid composition with a base oil matrix having a kinematic viscosity at 40° C. of <40 $mm^2/s$ (M) shows an OECD 301D biodegradability of about 40%. In a third embodiment, a hydraulic fluid composition with a base oil matrix having a kinematic viscosity at 40° C. of <8 $mm^2/s$ (L) shows an OECD 301D biodegradability of >=40%. In a fourth embodiment, a hydraulic fluid composition with a base oil matrix having a kinematic viscosity at 40° C. of <11 $mm^2/s$ shows an OECD 301D biodegradability of about 80%. In a fifth embodiment, a hydraulic fluid composition with a base oil matrix having a kinematic viscosity at 40° C. of <6 $mm^2/s$ shows an OECD 301D biodegradability of >93%.

Applications: In one embodiment, the hydraulic fluid composition is supplied to the fluid reservoir of the equipment to be lubricated, and thence to the moving parts of the equipment itself including but not limited to turbines, tractors and/or an off-highway mobile equipment. Moving parts include a transmission, a hydrostatic transmission, a gear box, a drive, a hydraulic system, etc.

The following Examples are given as non-limitative illustration of aspects of the present invention.

EXAMPLES

Unless specified otherwise, the Examples are prepared by mixing the components in the amounts indicated in the tables. The components used in the Examples of Table 1 are listed below:

FTBO base oils: are from Chevron Corporation of San Ramon, Calif. The properties of the FTBO base oils used in the examples are shown in Table 2.

UCBO™ 7R is a Group III base oil from Chevron Corporation; Chevron 600R is a Group II base oil from Chevron Corporation; Synfluid 6 cSt and Synfluid 8 cSt are PAO's from Chevron Corporation; Ashland 100 SN and Ashland 325 SN are solvent neutral base oil Group I; C Neut Oil 100R and 220R are neutral oil group II from Chevron Corporation.

Viscosity modifier is a commercially available polyalkyl methacrylate copolymer.

OLOA™ additive is an ash-containing hydraulic additive package (containing zinc dialkydithiophosphates) from Chevron Oronite Corp. of San Ramon, Calif.

Antioxidant A is a commercially available mixture of arylaminic and phenolic antioxidant.

EP/AW Additive & Corrosion Inhibitor is a commercially available mixture of amine phosphates for use as extreme pressure/antiwear and antirust additive.

Metal deactivator is a commercially available tolytriazole derivative.

Pour point depressant is a commercially available Polyalkyl methacrylate.

Examples 1-5 are ash-type formulations with the use of the additive package containing zinc dialkydithiophosphates. Examples 6-10 are ashless formulations. Comparing Examples 5 and 10 (both with FTBO oils), Example 5 employs FTBO oils made from entirely Fischer-Tropsch wax, more highly paraffinic wax having fewer multicycloparaffins. Example 10 employs FTBO oils made from a mixture of Fischer-Tropsch and petroleum waxes.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained and/or the precision of an instrument for measuring the value. Furthermore, all ranges disclosed herein are inclusive of the endpoints and are independently combinable. In general, unless otherwise indicated, singular elements may be in the plural and vice versa with no loss of generality. As used herein, the term "include" and its grammatical variants are intended to be non-limiting, such that recitation of items in a list is not to the exclusion of other like items that can be substituted or added to the listed items.

This written description uses examples to disclose the invention, including the best mode, and also to enable any person skilled in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

TABLE 1

| | Ex. 1 | Ex. 2 | Ex. 3 | Ex. 4 | Ex. 5 | Ex. 6 | Ex. 8 | Ex. 9 | Ex. 10 | Ex. 6 |
|---|---|---|---|---|---|---|---|---|---|---|
| | wt % | wt % | wt % | wt % | wt % | — | — | 86.457 | — | — |
| UCBO 7R | — | — | 94.524 | — | — | — | — | 12.893 | — | — |
| CHEVRON 600R | — | — | 4.546 | — | — | — | — | — | — | — |
| SYNFLUID 6 CST | — | — | — | 17.663 | — | — | — | — | 2.8255 | — |
| SYNFLUID 8 CST | — | — | — | 81.4068 | — | — | — | — | 96.5245 | — |
| ASHLAND 100 SN | 54.334 | — | — | — | — | 22.930 | — | — | — | — |
| ASHLAND 325 SN | 39.626 | — | — | — | — | 76.419 | — | — | — | — |
| C NEUT OIL 100R | — | 33.714 | — | — | — | | | — | — | — |
| C NEUT OIL 220R | — | 60.246 | — | — | — | | 87.599 | — | — | — |
| FTBO 17 | — | — | — | — | 97.126 | — | — | — | — | — |
| FTBO 18 | — | — | — | — | 1.943 | — | — | — | — | — |
| FTBO 74 | — | — | — | — | — | — | — | — | — | 90.5513 |
| FTBO 82 | — | — | — | — | — | — | — | — | — | 8.7985 |
| Viscosity modifier | 5.11 | 5.11 | 0.00 | 0.00 | 0.00 | — | — | — | — | — |
| OLOA additive package | 0.73 | 0.73 | 0.73 | 0.73 | 0.73 | — | — | — | — | — |
| Antioxidant A | — | — | — | — | — | 0.30 | 0.30 | 0.30 | 0.30 | 0.30 |
| EP/AW Additive Corrosion Inhibitor | — | — | — | — | — | 0.20 | 0.20 | 0.20 | 0.20 | 0.20 |
| Pour point depressant | 0.20 | 0.20 | 0.20 | 0.20 | 0.20 | 0.10 | 0.10 | 0.10 | 0.10 | 0.10 |
| Metal deactivator | — | — | — | — | — | 0.05 | 0.05 | 0.05 | 0.05 | 0.05 |
| Kinematic viscosity @40 C. | 44.05 | 43.72 | 43.75 | 43.73 | 43.61 | 46.03 | 46.17 | 46.38 | 45.57 | 46.04 |
| Kinematic viscosity @100 C. | 7.94 | 7.969 | 7.341 | 7.45 | 8.084 | 6.776 | 6.90 | 7.566 | 7.681 | 8.437 |
| VI | 153 | 156.15 | 132 | 136 | 161 | 100 | 105 | 129 | 137 | 162 |
| Flash Point, | 226 | 234 | 268 | 266 | 276 | 236 | 232 | 252 | 266 | 284 |
| RPVOT, Time to 25 PSI drop, min. | 337 | 455 | 547 | 578 | 617 | 345 | 385 | 585 | 746 | 863 |
| Peak Pressure, PSI | 185 | 189 | 187 | 181 | 188 | 190 | 187 | 191 | 183 | 181 |
| Water Separability, D1401 @54 C. o-w-e, ml | 43-37-0 | 41-38-1 | 40-39-1 | 39-38-3 | 40-38-2 | 43-37-0 | 43-37-0 | 43-37-0 | 42-38-0 | 42-38-0 |
| Time, min | 5 | 5 | 15 | 15 | 10 | 15 | 10 | 10 | 10 | 10 |
| copper strip D130@100 C. 3 hrs | 1b | 1b | 1b | 1b | 1b | 1b | 1b | 1b | 1b | 1b |
| Four Ball Wear, D4172 Scar diameter, mm | 0.5 | 0.52 | 0.52 | 0.5 | 0.39 | 0.43 | 0.44 | 0.43 | 0.43 | 0.43 |
| Air Release @50 C., D3427, min | 3.75 | 1.57 | 1.37 | 0 | 0.17 | 4.30 | 4.77 | 6.03 | 0.00 | 4.75 |
| AutoignitionTemp, ASTM E-659, C. | 349 | 332 | 349 | 359 | 366 | 344 | 340 | 354 | 363 | 369 |
| Ignition Delay Time, sec | 2.5 | 3 | 3 | 3 | 4 | 3.50 | 3.00 | 3.00 | 3.50 | 3.50 |
| Bar. ressure, mm Hg | 764 | 760 | 764 | 764 | 760 | 768.00 | 768.00 | 767.00 | 755.00 | 755.00 |
| Dielectric Strength, ASTM D877 | | | | | | — | — | — | — | — |
| Approximate viscosity @100 C., cSt | 7.86 | 7.9 | 7.29 | 7.37 | 8.03 | 6.79 | 6.91 | 7.58 | 7.70 | 8.46 |
| Sample Temperature | 23 | 23 | 23 | 23 | 23 | 24.00 | 24.00 | 24.00 | 24.00 | 24.00 |
| Room Temperature | 23 | 23 | 23 | 23 | 23 | 24.00 | 24.00 | 24.00 | 24.00 | 24.00 |
| First Breakdown | 42 | 54 | 45 | 38 | 39 | 42.00 | 40.00 | 39.00 | 32.00 | 44.00 |
| Second Breakdown | 39 | 52 | 36 | 44 | 39 | 40.00 | 45.00 | 37.00 | 40.00 | 40.00 |
| Third Breakdown | 43 | 48 | 43 | 42 | 41 | 39.00 | 36.00 | 36.00 | 37.00 | 41.00 |
| Fourth Breakdown | 37 | 50 | 45 | 45 | 44 | 34.00 | 38.00 | 37.00 | 41.00 | 43.00 |
| Fifth Breakdown | 40 | 52 | 40 | 40 | 42 | 40.00 | 41.00 | 40.00 | 34.00 | 40.00 |
| Average Breakdown | 40 | 51.2 | 41.8 | 41.8 | 41 | 39.00 | 40.00 | 37.80 | 36.80 | 41.60 |
| Foam Seq I-III, D892 | | | | | | — | — | — | — | — |
| Seq I | 0/0 | 0/0 | 0/0 | 0/0 | 0/0 | 70/440 | 570/350 | 520/300 | 360/0 | 520/210 |
| Seq II | 10/0 | 10/0 | 0/0 | 0/0 | 0/0 | 35/0 | 30/0 | 30/0 | 0/0 | 0/0 |
| Seq III | 0/0 | 0/0 | 0/0 | 0/0 | 0/0 | 550/350 | 550/350 | 510/280 | 430/30 | 500/50 |
| Tort B | | | | | | — | — | — | — | — |
| Degree of rusting | 0 | 0 | 0 | 0 | 0 | Moderate | Mod. | Light | Mod. | Light |
| Percent rusted | 0 | 0 | 0 | 0 | 0 | <5 | <5 | <5 | <5 | <5 |
| No. of spots | 0 | 0 | 0 | 0 | 0 | 5 | 13 | 1 | 20 | 2 |
| Rubber swell D471 100 C., 168 hrs. | | | | | | — | — | — | — | — |
| Ave. hardness change, pts | −3.89 | −2.70 | −0.97 | −0.66 | −0.08 | −4.02 | −2.34 | −0.96 | −0.36 | −0.32 |
| Ave. vol. change, % | 7.00 | 5.07 | 2.46 | 1.44 | 1.32 | 6.80 | 4.47 | 2.75 | 1.79 | 1.79 |
| Evaporation Loss, D-972 | | | | | | — | — | — | — | — |
| 22 hours @300 F., mass % | 8.17 | 7.02 | 1.17 | 0.45 | 0.2 | 4.32 | 4.01 | 1.03 | 0.44 | 0.34 |

TABLE 2

| | Sample/GQ ID | | | |
|---|---|---|---|---|
| | FTBO 74 | FTBO 82 | FTBO 17 | FTBO 18 |
| Kinematic Viscosity @ 40° C., cSt | 39.89 | 86.72 | 42.3 | 106.4 |
| Kinematic Viscosity @ 100° C., cSt | 7.597 | 13.14 | 7.929 | 16.01 |
| Viscosity Index | 162 | 152 | 162 | 161 |

TABLE 2-continued

| | Sample/GQ ID | | | |
|---|---|---|---|---|
| | FTBO 74 | FTBO 82 | FTBO 17 | FTBO 18 |
| Cold Crank Viscosity @ −40° C., cP | 30,067 | | 24,287 | |
| Cold Crank Viscosity @ −35° C., cP | 11,634 | | 10,149 | |
| Cold Crank Viscosity @ −30° C., cP | 3,831 | | 4,936 | 46,991 |
| Cold Crank Viscosity @ −25° C., cP | 2,658 | 16,528 | 2,584 | 18,905 |
| Pour Point, ° C. | −13 | −4 | −11 | −10 |
| n-d-m | | | | |
| Molecular Weight, gm/mol (VPO) | 527 | 724 | 549 | 743 |
| Density, gm/ml | 0.8252 | 0.8326 | 0.8241 | 0.8330 |
| Refractive Index | 1.4607 | 1.4642 | 1.4596 | 1.4641 |
| Paraffinic Carbon, % | 92.46 | 93.86 | 93.68 | 92.98 |
| Naphthenic Carbon, % | 7.54 | 6.14 | 6.32 | 7.02 |
| Aromatic Carbon, % | 0.00 | 0.00 | 0.00 | 0.00 |
| Oxidator BN, hrs | 45.42 | 33.52 | 45.86, 45.72 | 45.32, 43.95 |
| Noack, wt. % | 3.92 | 0.86 | 2.02 | 0.95 |
| HPLC-UV (LUBES) | | | | |
| 1-Ring | 0.01585 | 0.04479 | 0.00414 | 0.02737 |
| 2-Ring | 0.00098 | 0.00448 | 0.00124 | 0.00325 |
| 3-Ring | 0 | 0 | 0 | 0 |
| 4-Ring | 0 | 0 | 0 | 0 |
| 6-Ring | 0 | 0 | 0 | 0 |
| Aromatics Total | 0.01683 | 0.04927 | 0.00538 | 0.03062 |
| SIMDIST TBP (WT %), F. | | | | |
| TBP @0.5 | 679 | 906 | 832 | 915 |
| TBP @5 | 778 | 953 | 869 | 963 |
| TBP @10 | 862 | 974 | 884 | 988 |
| TBP @20 | 886 | 995 | 902 | 1011 |
| TBP @30 | 902 | 1007 | 916 | 1040 |
| TBP @40 | 918 | 1020 | 928 | 1057 |
| TBP @50 | 934 | 1036 | 940 | 1074 |
| TBP @60 | 950 | 1048 | 953 | 1092 |
| TBP @70 | 972 | 1061 | 971 | 1113 |
| TBP @80 | 994 | 1078 | 989 | 1141 |
| TBP @90 | 1026 | 1106 | 1006 | 1181 |
| TBP @95 | 1056 | 1140 | 1022 | 1213 |
| TBP @99.5 | 1132 | 1228 | 1056 | 1290 |
| FIMS by Probe sample introduction | | | | |
| Saturates | 58.3 | 42.7 | 70 | 65.4 |
| 1-Unsaturation | 34.4 | 39.4 | 27.9 | 33.1 |
| 2-Unsaturation | 6.4 | 10.3 | 2 | 1.2 |
| 3-Unsaturation | 0.9 | 5.2 | 0 | 0.3 |
| 4-Unsaturation | 0.0 | 1.9 | 0 | 0 |
| 5-Unsaturation | 0.0 | 0.4 | 0 | 0 |
| 6-Unsaturation | 0.0 | 0.0 | 0.1 | 0 |
| Branching Index | 23.58 | 20.12 | 23.20 | 20.83 |
| Branching Proximity | 23.35 | 28.02 | 22.71 | 27.05 |
| Alkyl Branches per Molecule | 3.13 | 3.89 | 3.34 | 4.02 |
| Methyl Branches per Molecule | 2.59 | 3.26 | 2.73 | 3.29 |
| BI − 0.5BP | 11.91 | 6.11 | 11.85 | 7.31 |
| BI + 0.85BP | 43.43 | 43.94 | 42.51 | 43.83 |
| FCI | 8.79 | 14.49 | 8.91 | 14.36 |
| FCI/END Methyl Ratio | 6.11 | 8.89 | 6.76 | 9.88 |
| Alkyl Branches per 100 Carbons | 8.32 | 7.53 | 8.53 | 7.58 |
| Methyl Branches per 100 Carbons | 6.89 | 6.30 | 6.97 | 6.20 |
| Monocycloparaffin (FIMS 1-unsat-NMR Olefins) | 34.4 | 39.4 | — | — |
| Multicycloparaffin (FIMS 2-Unsat-6Unsat - HPLC-UV Aromatics) | 7.3 | 17.8 | — | — |
| Mono/Multi ratio | 4.7 | 2.2 | — | — |

The invention claimed is:

1. A hydraulic fluid composition comprising (i) 80 to 99.999 wt. % of a lubricating base oil; (ii) optionally from 0.001 to 6 wt % of a viscosity modifier; and (iii) 0-10 wt % of at least an additive package; wherein the lubricating base oil has consecutive numbers of carbon atoms, less than 10 wt % naphthenic carbon by n-d-M, less than 0.10 wt. % olefins and less than 0.05 wt. % aromatics, a molecular weight of greater than 600 by ASTM D 2503-92 (Reapproved 2002), a wt % total molecules with cycloparaffinic functionality greater than 25 and a ratio of molecules with monocycloparaffinic functionality to molecules with multicycloparaffinic functionality greater than 10; and wherein the hydraulic fluid composition results in an average volume change in a rubber seal of less than 3% and an average hardness change in the rubber seal of less than 1 pts. when tested under ASTM D 471-06 (SRE NBR1 at 100° C., 168 hours).

2. The hydraulic fluid composition of claim 1, wherein the hydraulic fluid composition results in an average volume change in a rubber seal of less than 1.75% and an average hardness change in the rubber seal of less than 0.3 pts. when tested under ASTM D 471-06 (SRE NBR1 at 100° C., 168 hours).

3. The hydraulic fluid composition of claim 1, wherein the composition comprises less than 1 wt. % seal swell additive.

4. The hydraulic fluid composition of claim 1, wherein the composition comprises less than 0.5 wt. % seal swell additive.

5. The hydraulic fluid composition of claim 1, having a viscosity index (VI) of at least 150.

6. The hydraulic fluid composition of claim 3, having a VI of at least 160.

7. The hydraulic fluid composition of claim 1, having a flash point of at least 270° C.

8. The hydraulic fluid composition of claim 1, having an auto-ignition temperature of at least 360° C.

9. The hydraulic fluid composition of claim 1, having an evaporation loss of less than 1 mass % after 22 hours at 149° C., as measured according to ASTM D972-02.

10. The hydraulic fluid composition of claim 1, having an evaporation loss of less than 0.5 mass % per ASTM D972-02, 22 hours at 149° C.

11. The hydraulic fluid composition of claim 1, wherein the lubricating base oil has a molecular weight of 500-750.

12. The hydraulic fluid composition of claim 11, wherein the lubricating base oil has a molecular weight of greater than 650.

13. The hydraulic fluid composition of claim 1, wherein the lubricating base oil has a kinematic viscosity at 100° C. in the range of 1 and 15 mm2/s and a Noack volatility less than an amount defined by the equation: 900×(kinematic viscosity at 100° C.)$^{-2.8}$−15.

14. The hydraulic fluid composition of claim 1, wherein the lubricating base oil has an average molecular weight between 600 and 1100, and an average degree of branching in the molecules between 6.5 and 10 alkyl branches per 100 carbon atoms.

15. The hydraulic fluid composition of claim 1, wherein the lubricating base oil has an auto-ignition temperature in ° C. (AIT) greater than an AIT in ° C. defined by: 1.6×(kinematic viscosity at 40° C., in mm2/s)+300 and a traction coefficient less than an amount calculated by: 0.009×Ln (kinematic viscosity in mm2/s)−0.001, wherein the kinematic viscosity is the viscosity of the oil during the measurement of the traction coefficient.

16. The hydraulic fluid composition of claim 1, wherein the lubricating base oil consists essentially of at least an isomerized base oil having a biodegradability of at least 80% as measured according to OECD 301D.

17. The hydraulic fluid composition of claim 1, comprising from 0.01 to 6 wt. %. of a viscosity modifier selected from the group of a) poly alkyl(meth)acrylates; b) functionalized poly alkyl(meth)acrylates; c) a polyisobutylene having a weight average molecular weight ranging from 700 to 2,500; d) a graft copolymer comprising a polymer backbone which has been grafted by reacting the polymer backbone with a reactant comprising N-p-diphenylamine,1,2,3,6-tetrahydrophthalimide; 4-anilinophenyl methacrylamide; 4-anilinophenyl maleimide; 4-anilinophenyl itaconamide; an acrylate or methacrylate ester of 4-hydroxydiphenylamine; a reaction product of p-aminodiphenylamine or p-alkylaminodiphenylamine with glycidyl methacrylate; a reaction product of p-aminodiphenylamine with isobutyraldehyde, a derivative of p-hydroxydiphenylamine; a derivative of phenothiazine; a vinylogous derivative of diphenylamine; and mixtures thereof.

18. The hydraulic fluid composition of claim 1, wherein the hydraulic fluid composition comprises at least a pour point depressant selected from the group of pour point reducing blend components; polymethacrylates; polyacrylates; polyacrylamides; condensation products of haloparaffin waxes and aromatic compounds; vinyl carboxylate polymers; terpolymers of dialkylfumarates, vinyl esters of fatty acids, and alkyl vinyl ethers; and mixtures thereof.

19. The hydraulic fluid composition of claim 1, wherein the lubricating base oil comprises Fischer-Tropsch base oil having a kinematic viscosity at 100° C. between 6 mm$^2$/s and 20 mm$^2$/s; a kinematic viscosity at 40° C. between 30 mm$^2$/s and 120 mm$^2$/s; a viscosity index between 150 and 165; Cold crank viscosity in the range of 3,000-50,000 mPa·s at −30° C., 2,000-20,000 mPa·s at −25° C.; pour point in the range of −2 and −20° C.; molecular weight of 500-750; density in the range of 0.820 to 0.840; paraffinic carbon in the range of 92-95%; naphthenic carbon in the range of 5-8%; Oxidator BN of 30 to 50 hours; and Noack volatility in wt. % of 0.50 to 5.

20. The hydraulic fluid composition of claim 1, wherein the hydraulic fluid composition further comprises at least at least a viscosity modifier selected from the group of a) poly alkyl (meth)acrylates; b) functionalized poly alkyl(meth)acrylates; c) a polyisobutylene having a weight average molecular weight ranging from 700 to 2,500; d) a graft copolymer comprising a polymer backbone which has been grafted by reacting the polymer backbone with a reactant comprising N-p-diphenylamine, 1,2,3,6-tetrahydrophthalimide; 4-anilinophenyl methacrylamide; 4-anilinophenyl maleimide; 4-anilinophenyl itaconamide; an acrylate or methacrylate ester of 4-hydroxydiphenylamine; a reaction product of p-aminodiphenylamine or p-alkylaminodiphenylamine with glycidyl methacrylate; a reaction product of p-aminodiphenylamine with isobutyraldehyde, a derivative of p-hydroxydiphenylamine; a derivative of phenothiazine; a vinylogous derivative of diphenylamine; and mixtures thereof.

21. The hydraulic fluid composition of claim 19, wherein the pour point depressant is a pour point reducing blend component having an average degree of branching within a range of 6.5 to 10 alkyl branches per 100 carbon atoms.

22. The hydraulic fluid composition of claim 1, wherein the lubricating base oil is a Fischer-Tropsch base oil having 0.001 to 0.05 wt. % aromatics and a molecular weight of greater than 600 by ASTM D 2503-92 (Reapproved 2002).

23. The hydraulic fluid composition of claim 1, wherein the lubricating base oil comprises at least a Fischer-Tropsch base oil and 5 to 95 wt. % of at least a lubricant base oil selected from Group I, II, III, IV, and V lubricant base oils as defined in the API Interchange Guidelines, and mixtures thereof.

24. A method for operating a hydraulic transmission having seals subject to deterioration and leakage, the method comprising using a hydraulic fluid composition comprising (i) 80 to 99.999 wt. % of a lubricating base oil; (ii) from 0.001 to 6 wt % of a viscosity modifier; and (iii) 0-10 wt % of at least an additive package; wherein the lubricating base oil has consecutive numbers of carbon atoms, less than 10 wt % naphthenic carbon by n-d-M, less than 0.10 wt. % olefins and less than 0.05 wt. % aromatics, a molecular weight of greater than 600 by ASTM D 2503-92 (Reapproved 2002), a wt % total molecules with cycloparaffinic functionality greater than 25 and a ratio of molecules with monocycloparaffinic functionality to molecules with multicycloparaffinic functionality greater than 10; and wherein the hydraulic fluid composition results in an average volume change in a rubber seal of less than 3% and an average hardness change in the rubber seal of less than 1 pts. when tested under ASTM D 471-06 (SRE NBR1 at 100° C., 168 hours).

* * * * *